US007052173B2

(12) United States Patent
Hiranuma et al.

(10) Patent No.: US 7,052,173 B2
(45) Date of Patent: May 30, 2006

(54) TIMEPIECE

(75) Inventors: Haruki Hiranuma, Chiba (JP); Nobukazu Omori, Chiba (JP); Hisamitsu Yoshikawa, Chiba (JP)

(73) Assignee: Seiko Instruments Inc., Chiba (JP)

( * ) Notice: Subject to any disclaimer, the term of this patent is extended or adjusted under 35 U.S.C. 154(b) by 110 days.

(21) Appl. No.: 10/885,904

(22) Filed: Jul. 7, 2004

(65) Prior Publication Data

US 2005/0013204 A1 Jan. 20, 2005

(30) Foreign Application Priority Data

Jul. 14, 2003 (JP) ..... 2003-196676

(51) Int. Cl.
*G04B 37/00* (2006.01)
*G04B 39/00* (2006.01)

(52) U.S. Cl. ..... 368/294; 368/295

(58) Field of Classification Search ..... 368/294, 368/295, 309, 310, 281, 88
See application file for complete search history.

(56) References Cited

U.S. PATENT DOCUMENTS 5,122,997 A * 6/1992 Schneider et al. ..... 368/294
5,541,895 A * 7/1996 Nussbaum ..... 368/295
5,822,279 A * 10/1998 Cuche et al. ..... 368/295
6,819,632 B1 * 11/2004 Paul ..... 368/88
6,821,014 B1 * 11/2004 Hiranuma et al. ..... 368/295

FOREIGN PATENT DOCUMENTS

JP 5312972 11/1993

* cited by examiner

*Primary Examiner*—Vit Miska
*Assistant Examiner*—Samuel L Hagins
(74) *Attorney, Agent, or Firm*—Adams & Wilks

(57) ABSTRACT

To provide a timepiece whose bezel can be easily attached and detached by a user without requiring a special-purpose tool. A male screw, an annular groove disposed downwardly away from the male screw and an annular clearance groove positioned between the annular groove and the male screw are provided on the outer periphery of an annular convex of a case band to which a cover glass is attached. A soft and resilient engagement ring is fitted to the annular groove such that the engagement ring projects out from the annular groove. A bezel includes on its inner periphery a female screw disposed within the clearance groove for releasably engaging with the male screw and an annular engagement convex having a stopper slope. The stopper slope is disposed below the female screw to tightly contact with the outer periphery of the ring. The bezel attached in a condition in which the ring tightly contacts with the stopper slope is rotated in a loosening direction of the bezel through a screw-engagement between the screws. Subsequently, the engagement convex passes through the ring upwardly to be positioned above the ring, and the bezel is finally separated.

4 Claims, 5 Drawing Sheets

TIMEPIECE

BACKGROUND OF THE INVENTION

1. Field of the Invention

The present invention pertains to a timepiece such as a wrist watch and a pocket watch, and more particularly to a timepiece comprising an attachable and detachable bezel.

2. Description of the Prior Art

It is preferable to make a bezel attachable and detachable, since upon maintenance a damaged bezel can be replaced not only with a bezel of the same type, but also with a bezel of a different type having a different design which offers a different decorative effect at will.

According to a first example of a conventional wrist watch including an attachable and detachable bezel, an annular protrusion is formed on the outer periphery of an annular step defined on a case band the inner periphery of which a cover glass is attached to. Another annular protrusion formed on the inner periphery of a rotating bezel engages with the protrusion formed on the case band from below (for example, see JP-A-10-239454 (paragraphs 0003 through 0005, paragraphs 0018 through 0028, FIGS. 1 through 5, FIGS. 19 through 23) and JP-A-5-312972(FIGS. 1 and 2)).

According to a second example of a conventional wrist watch, an annular groove is formed on each of oppositely disposed faces of an annular step of case band and a rotating bezel engaging with the step, and a polygonal spring is fitted to the grooves so as to prevent the rotating bevel from slipping off the step (for example, see JP-A-10-239454).

Additionally, according to a third example of a conventional wrist watch, a rotating bezel has an outside bezel and an inside bezel releasably screw-engaging with the outside bezel, and the outside bezel is fixed to an annular step of a case band by means of a polygonal spring so as to avoid the separation of the rotating bezel from the step (for example, see JP-A-10-239454).

In the first example of the related art, the connection between the case band and the bezel is strong. Thus, for separating the bezel from the case band, it is necessary to insert a specialized thin plate tool between the bezel and the case band and force the bezel open by the tool. Accordingly, the bezel is very likely to be damaged by a great operational force given thereto, and such a great force is also required to attach the bezel to the case band.

In the second example of the related art, it is necessary to insert a specialized thin plate tool between the bezel and the case band and force the bezel open by the tool for detaching the bezel from the case band since the polygonal spring cannot be directly deformed. Moreover, the polygonal spring is costly.

In the third example of the related art, for removing the bezel from the case band the inside bezel is first removed from the outside bezel, and subsequently the outside bezel is separated from the case band by deforming the polygonal spring. However, for the attachment and removal of the inside bezel to and from the outside bezel, the inside bezel needs to be rotated by a tool which catches a plurality of concaves of the inside bezel. Thus, a special-purpose tool is still required in this case. Furthermore, an additional specialized tool for the polygonal spring is needed for deforming the polygonal spring apart from the tool for the inside bezel. In addition, the polygonal spring is costly.

As mentioned above, a special-purpose tool is required at least for separating the bezel from the case band in any of the related art examples. Thus, it is difficult for a user to replace the bezel with ease even if a bezel of a different type having a different design can be offered. Accordingly, the attachment and removal of the bezel is done at a watch store or by other specialist, which is inconvenient for a user.

An object to be achieved by the present invention is to provide a timepiece having a bezel which is easily attached and removed by a user without requiring a specialized tool.

SUMMARY OF THE INVENTION

In order to achieve the above object, in the present invention there are provided a male screw formed at the outer periphery of an annular convex of a case band to which a cover glass is attached, an annular groove provided at the outer periphery of the annular convex downwardly away from the male screw, and an annular clearance groove provided between the annular groove and the male screw. A soft and resilient engagement ring is fitted to the annular groove such that the engagement ring projects out from the annular groove. A bezel has a female screw releasably engaging with the male screw and an annular engagement convex disposed below the female screw. The female screw passes through the male screw to be disposed within the clearance groove. The engagement convex has a stopper slope which tightly contacts with the outer periphery of the engagement ring.

According to the invention, the bezel can be attachedly supported on the case band by the engagement between the engagement ring supported on the case band and the stopper slope of the engagement convex provided on the bezel. The bezel thus attached is lifted to bring the female screw of the bezel into screw-engagement with the male screw, and the bezel is rotated in a loosening direction thereof. As a result, the engagement convex of the bezel passes through the engagement ring supported on the case band to be positioned above the engagement ring, and the bezel is finally separated.

Similarly, for achieving the above object, in the present invention there are provided a male screw formed at the outer periphery of an annular convex of a case band to which a cover glass is attached, an annular engagement convex provided at the outer periphery of the annular convex downwardly away from the male screw, and an annular clearance groove provided between the engagement convex and the male screw. The annular engagement convex has a stopper slope. A bezel has a female screw releasably engaging with the male screw and an annular groove disposed below the female screw. The female screw passes through the male screw to be disposed within the annular clearance groove. A soft and resilient engagement ring is fitted to the annular groove such that the engagement ring projects out from the annular groove. The inner periphery of engagement ring tightly contacts with the stopper slope.

According to the invention, the bezel can be attachedly supported on the case band by the engagement between the engagement ring supported on the bezel and the stopper slope of the engagement convex provided on the case band. The bezel thus attached is lifted to bring the female screw of the bezel into screw-engagement with the male screw, and the bezel is rotated in a loosening direction thereof. As a result, the engagement ring supported on the bezel passes through the engagement convex of the case band to be positioned above the engagement convex, and the bezel is finally separated.

A preferred example in which the bezel can be adjustably rotated in a circumferential direction thereof is within the scope of the invention.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

A first embodiment of the present invention is hereinafter described in conjunction with FIGS. 1 through 3.

Figure 1:
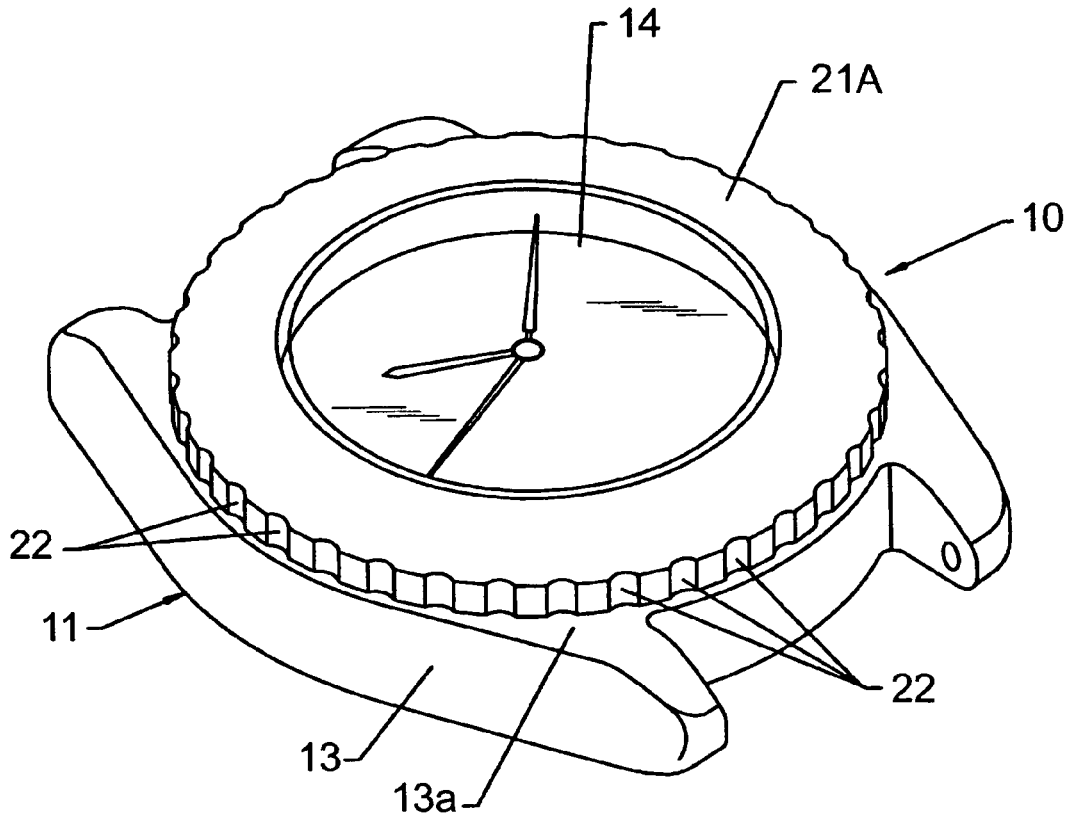
FIG. 1 is a perspective view illustrating a watch of a first embodiment according to the present invention.

A reference numeral 11 in FIG. 1 denotes a watch which is attached to, for example, the wrist for use. A not-shown watch movement, a dial and other components are contained within a watch casing assembly 11 included in the watch 10. As illustrated in FIG. 2, the watch casing assembly 11 has an annular case band 13 made from metal or synthetic resin. A cover glass 14 is liquid-tightly attached to one face (front face) of the case band 13 in a thickness direction thereof, and a not-shown case back removably screwed into the other face (back face) of the case band 13 in the opposite thickness direction. The dial is visible through the cover glass 14.

An annular convex 15 formed integral with the case band 13 projects out to the front thereof. The cover glass 14 is attached to the inner periphery of the annular convex 15. A reference numeral 13*a* in FIG. 2 denotes a casing surface which is formed in succession from the root of the annular convex 15 preferably perpendicular thereto.

Figure 2:
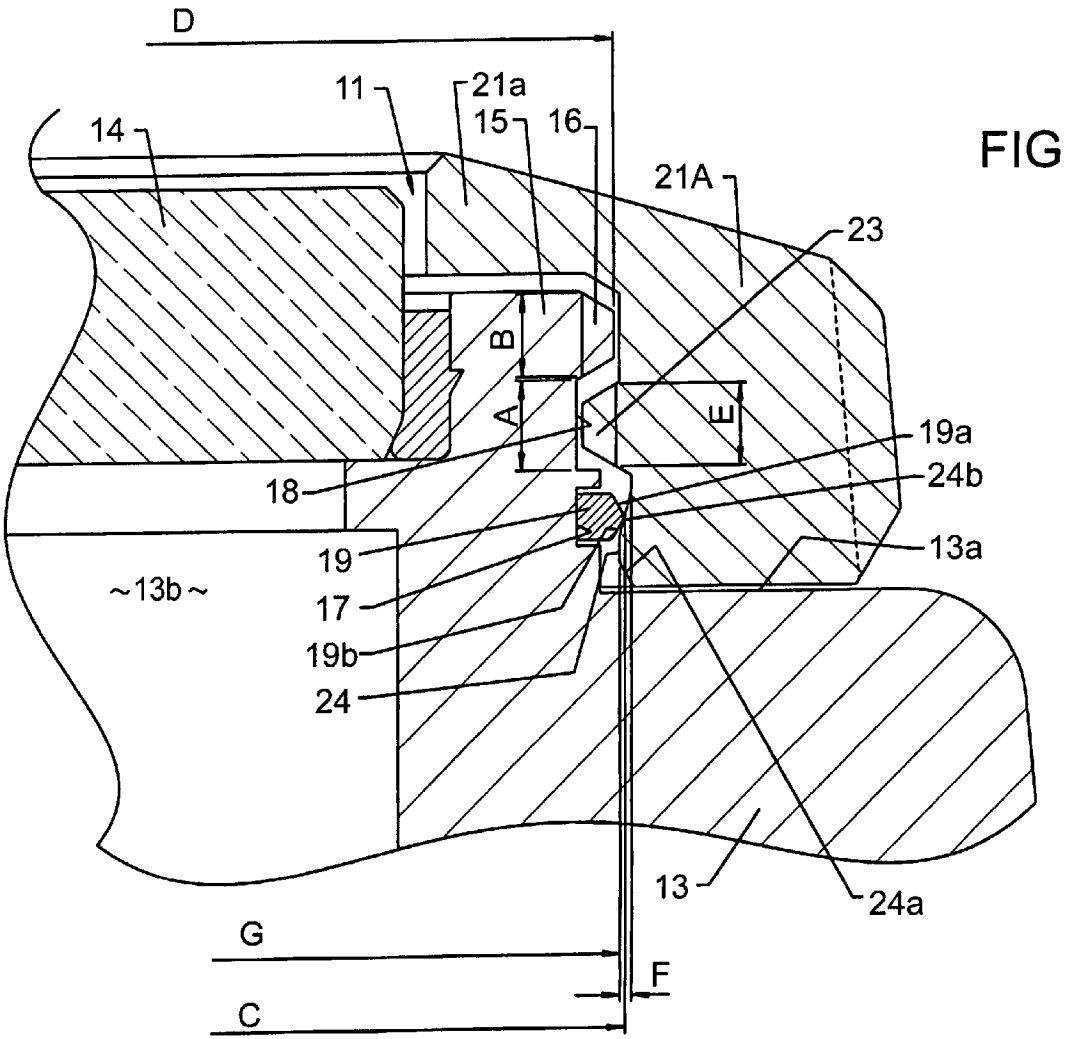
FIG. 2 is a partially enlarged cross-sectional view of the watch in FIG. 1.

As illustrated in FIG. 2, a male screw 16, an annular groove 17 and a clearance groove 18 are formed on the outer periphery of the annular convex 15. More specifically, the male screw 16 is provided at the tip of the outer periphery of the annular convex 15. The annular groove 17 is positioned downwardly away from the male screw 16, in other words, located closer to the casing surface 13*a* than to the male screw 16. The clearance groove 18 is annular and disposed between the male screw 16 and the annular groove 17. The groove base of the clearance groove 18 at the inner side thereof is disposed closer to a case band inner space 13*b* of the case band 13 than the bottom of the male screw 16 is located. That is, the clearance groove 18 is formed deeper than the bottom of the male screw 16. The case band inner space 13*b* accommodates the watch movement and other components. A groove width A of the clearance groove 18 is larger than the width of the male screw 16.

A soft and resilient engagement ring 19 is engagedly fitted to the annular groove 17 defined on the outer periphery of the annular convex 15. The engagement ring 19 is formed from synthetic resin or rubber (including natural rubber and synthetic rubber), and protrudes from the annular groove 17. The outer periphery of the engagement ring 19 includes an upper slope 19*a* and a lower slope 19*b*, and has a tapered side such that substantially the center of the engagement ring 19 in the thickness direction thereof projects out. Accordingly, the engagement ring 19 has an almost pentagon-shaped cross section like a piece used in Japanese chess. The outer periphery of the engagement ring 19 may be semicircular in shape in the thickness direction thereof. An outside diameter C of the engagement ring 19 is larger than an outside diameter D of the male screw 16.

The watch casing assembly 11 includes a bezel 21A which is removably attached to the case band 13 to be used as a decorative ring. The bezel 21A is annular and formed from metal, synthetic resin or other material. The bezel 21A is fitted such that the bezel 21A caps the annular convex 15 and that the position of the bezel 21A in its circumferential direction can be adjusted by rotating the bezel 21A. The bezel 21A is provided with a cover 21*a* disposed oppositely to the end surface of the annular convex 15. The periphery of the bezel 21A has a plurality of grooves 22 (shown in FIG. 1) at predetermined intervals for preventing the fingers from slipping from the bezel 21A during its rotational operation.

As illustrated in FIG. 2, a female screw 23 and an engagement convex 24 are formed on the inner periphery of the bezel 21A for allowing the attachment and removal of the bezel 21A. More specifically, the female screw 23 has a length E which is equal to or shorter than the length B of the male screw 16 such that the female screw 23 releasably engages with the male screw 16 of the case band 13. The engagement convex 24 is annular and positioned downwardly away from the female screw 23, that is, close to the back surface opening of the bezel 21A. The engagement convex 24 has a guide slope 24*a* at its lower portion and a stopper slope 24*b* at its upper portion. A reference sign F in FIG. 2 shows the height of the engagement convex 24. The stopper slope 24*b* gradually retreats from the guide slope 24*a* toward the female screw 23. A minimum inside diameter G of the engagement convex 24 is smaller than the outside diameter C of the engagement ring 19, and larger than the outside diameter D of the male screw 16.

Figure 3B:
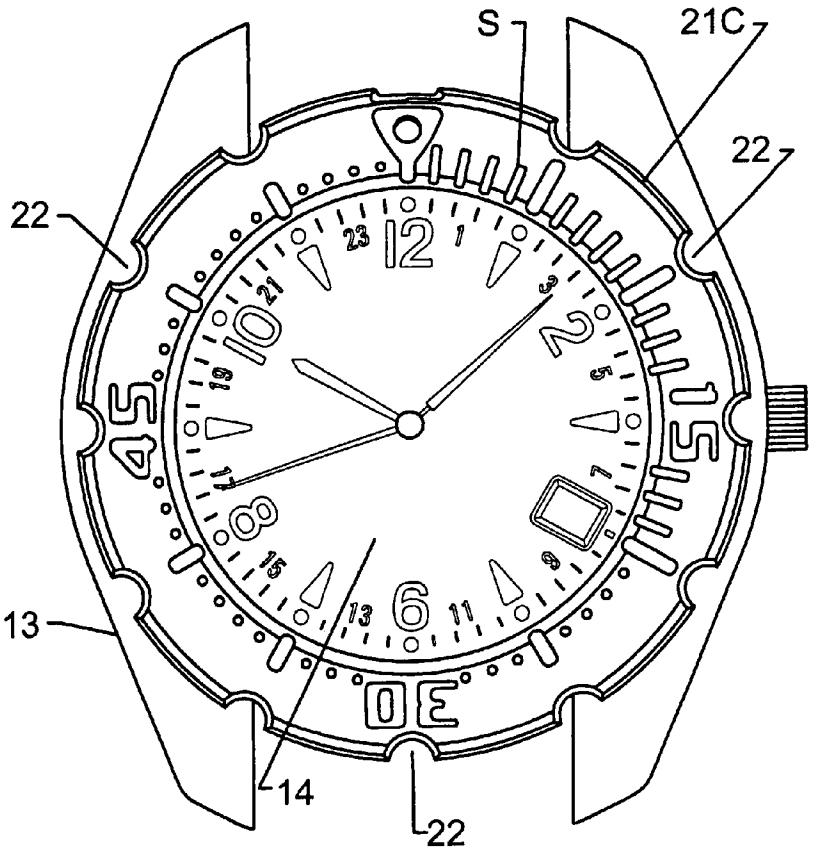
FIGS. 3A and 3B are plan views each showing a condition in which a bezel of the watch in FIG. 1 is replaced with another bezel of a different type.
Figure 3A:
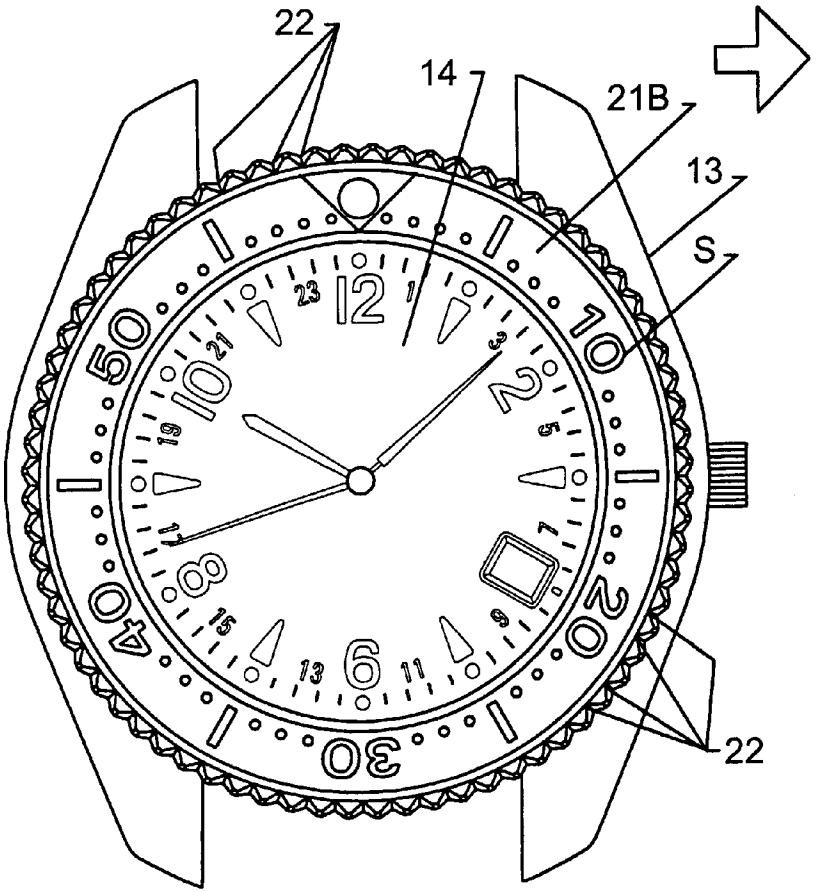

Reference numerals 21B and 21C in FIGS. 3A and 3B each denote a bezel of a type different from the bezel 21A, and on each front face of the bezels 21B and 21C an elapsed time indication S is provided which is designed differently from each other as shown in FIGS. 3A and 3B. A female screw and an engagement convex (both not shown) identical to the female screw 23 and the engagement convex 24 formed on the inner periphery of the bezel 21A are provided on each of the inner peripheries of the bezels 21B and 21C. The bezels 21B and 21C are prepared as replaceable components, and are purchased in advance when the watch 10 is purchased, or to be purchased later at a watch store every time they are needed.

The bezel 21A is attached to the case band 13 in a manner as follows. First, the bezel 21A is fitted to the annular convex 15 such that the bezel 21A caps the annular convex 15. Since the minimum inside diameter G of the engagement convex 24 is larger than the outside diameter D of the male screw 16, the disposition of the engagement convex 24 below the male screw 16 is not hindered by the presence of the male screw 16.

When the bezel 21A is fitted to the annular convex 15 as above, the female screw 23 of the bezel 21A contacts the male screw 16 of the case band 13. At this stage, the bezel 21A is rotated in a tightening direction in which the female screw 23 screw-engages with the male screw 16. This screwing action moves the bezel 21A closer to the casing surface 13*a* of the case band 13, and thus the guide slope 24*a* of the engagement convex 24 contacts the upper slope 19*a* of the engagement ring 19 halfway through the screwing action. However, since the screwing action of the bezel 21A continues while moving the bezel 21A due to the screwing action, the projecting end of the engagement convex 24 passes through the outer peripheral projecting end of the engagement ring 19 while elastically deforming the engagement ring 19.

After the engagement convex 24 passing through the engagement ring 19 as described above, the female screw 23 passes below the male screw 16. Subsequently, the female screw 23 is accommodated within the clearance groove 18 positioned below the male screw 16, and the bezel 21A starts unengaged rotation. In this condition, the bezel 21A is pushed till the bezel 21A contacts the casing surface 13*a*. Then, the outer periphery of the engagement ring 19 tightly contacts the stopper slope 24*b* of the engagement convex 24 due to the resiliency of the engagement ring 19, and the attachment process of the bezel 21A is completed. The condition of the bezel 21A thus attached is shown in FIG. 2.

When the bezel 21A is attached in the condition as above, the outer periphery of the engagement ring 19 tightly contacts with the stopper slope 24*b* of the engagement convex 24 resiliently. Thus, the engagement ring 19 functions as a stopper and the bezel 21A does not slip off upwardly. Also, an accidental rotation of the bezel 21A in the circumferential direction thereof is prevented by the frictional force of the engagement ring 19. When the bezel 21A is intentionally rotated by a user, however, the bezel 21A can be revolved to a predetermined position while resisting the frictional force.

When it is desired to detach the bezel 21A from the case band 13 for removing dust caught between the bezel 21A and the casing surface 13*a* of the case band 13 or for other purpose, the bezel 21A can be separated in the same manner as the above attachment process but proceeding in the reverse order.

More specifically, the bezel 21A is first rotated in the loosening direction thereof while lifting the bezel 21A by hand resisting the elasticity of the engagement ring 19. By this action, the female screw 23 of the bezel 21A is brought into engagement with the male screw 16 of the case band 13. Subsequent to this condition, the rotation of the bezel 21A in the loosening direction is continued to move the bezel 21A upward by the engagement between the female screw 23 and the male screw 16. By the upward movement of the bezel 21A, the engagement convex 24 passes through the engagement ring 19 upwardly to be positioned above the engagement ring 19. Then, the female screw 23 disengages from the male screw 16, and the removal of the bezel 21A is thus completed.

As described above, the attachment and removal of the bezel 21A to and from the case band 13 can be easily and manually performed without requiring a specialized tool. Thus, the bezel 21A can be fitted and separated by a user as well as a specialist at a watch store without damaging the bezel 21A or other component.

Accordingly, the bezel 21A shown in FIG. 1 can be easily replaced with a not-shown bezel of the same type but having a different color or with bezels 21B and 21C of different types shown in FIGS. 3A and 3B, respectively, by a user through the above-described procedures. When the bezel is replaced with a different bezel, the watch 10 gives a completely different impression. Additionally, since the engagement ring 19 is fitted to the case band 13 in the first embodiment, the engagement ring 19 can be used as a common component for bezels as replacement parts.

Figure 4:
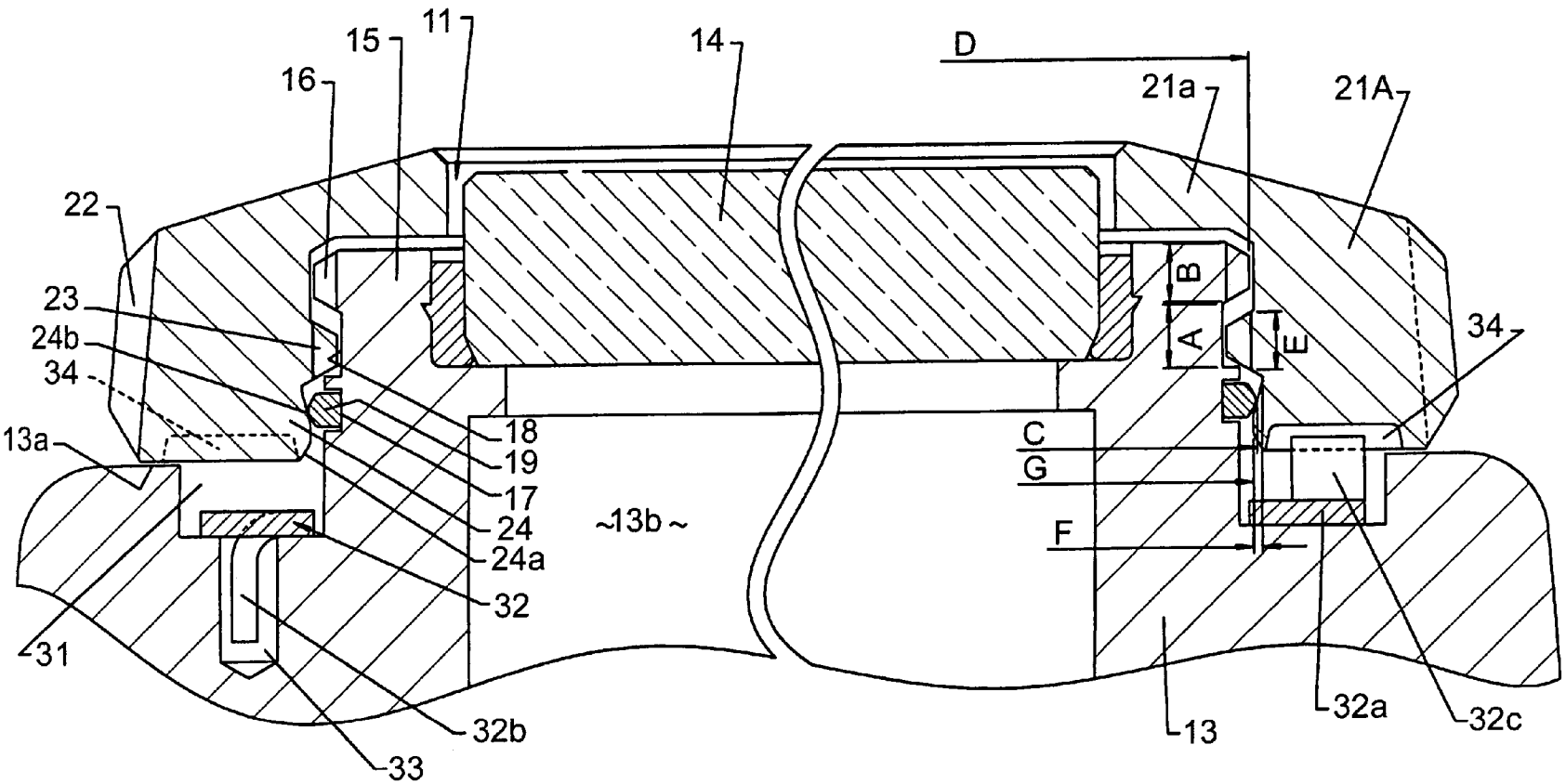
FIG. 4 is a partially enlarged cross-sectional view of a watch in a second embodiment according to the present invention.

FIG. 4 illustrates a second embodiment of the present invention. This embodiment basically has similar aspects to those in the first embodiment, and therefore only the points differing from the descriptions in the first embodiment are mentioned while omitting the similar descriptions on the similar operations and components to which the identical reference numerals as included in the first embodiment are given.

In the second embodiment, an annular groove 31 which opens to the casing surface 13*a* is formed on the case band 13. The groove 31 contains a flat spring 32 for positioning control. The flat spring 32 stops its rotation by inserting a plurality of stopper pieces 32*b* (only one piece shown) folded at the back face of an annular base 32*a* into engagement holes 33 continuously formed at a part of the groove 31. The surface of the flat spring 32 has a plurality of orthogonally cut and raised spring pieces 32*c* (only one piece shown) whose tips are folded as engagement ends. Engagement concaves 34 are formed on the lower surface of the bezel 21A at fixed intervals in the circumferential direction thereof.

During the rotational operation of the bezel 21A, the engagement ends of the spring pieces 32*c* engage with and disengage from the engagement concaves 34 with the spring pieces 32*c* elastically deformed. Thus, the rotation of the bezel 21A can be positioned at fixed angles. When it is desired to regulate the rotation of the bezel 21A in one direction, the following method can be adopted as an example. The engagement ends are laterally disposed S-shaped as viewed from the side thereof, and front sides of concave wall surfaces of the engagement concaves 34 in the rotational direction of the bezel are substantially vertical. In this structure, the almost vertical concave wall surfaces impinge on the tips of the engagement ends to prevent the reverse rotation of the bezel 21A when the bezel 21A reversely rotates. All the aspects in the second embodiment including structures not shown in FIG. 4 except for the points described above are similar to those in the first embodiment.

Therefore, the object of the present invention can also be achieved in the second embodiment which offers similar advantages to those in the first embodiment.

Figure 5:
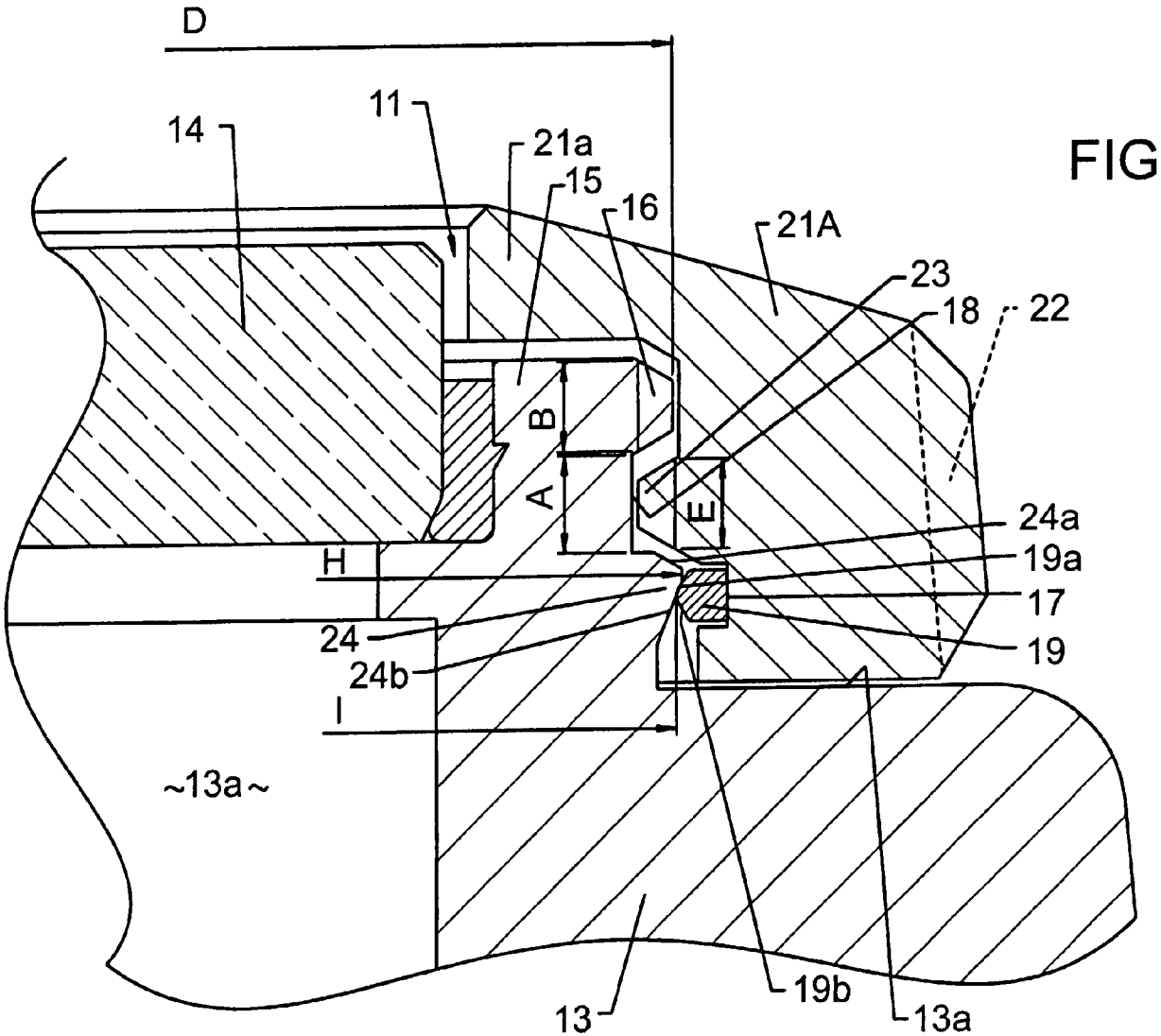
FIG. 5 is a partially enlarged cross-sectional view of a watch in a third embodiment according to the present invention.

FIG. 5 illustrates a third embodiment of the present invention. This embodiment basically has similar aspects to those in the first embodiment, and therefore only the points differing from the descriptions in the first embodiment are mentioned while omitting the similar descriptions on the similar operations and components to which the identical reference numerals as included in the first embodiment are given.

In the third embodiment, the engagement ring 19 is fitted to the annular groove 17 formed on the inner periphery of the bezel 21A instead of being attached to the annular convex 15 of the case band 13, and accordingly the annular engagement convex 24 is provided on the annular convex 15 of the case band 13 instead of being equipped on the inner periphery of the bezel 21A.

In this structure, a maximum diameter H of the engagement convex 24 and an inside diameter I of the engagement ring 19 are both larger than the outside diameter D of the male screw 16. Also, the maximum diameter H of the engagement convex 24 is larger than the inside diameter I of the engagement ring 19. Thus, in the condition in which the bezel 21A is fitted to the case band 13, the inner periphery of the engagement ring 19 passes through the outer peripheral projecting end of the engagement convex 24 downwardly, where the inner periphery of the engagement ring 19 is resiliently brought into tight contact with the stopper slope 24*b* disposed at the lower portion of the engagement convex 24 which is raised upwardly from the underside thereof. The bezel 21A is supported on the case band 13 by the tight contact thus created. All the aspects in the third embodiment including structures not shown in FIG. 5 except for the points described above are similar to those in the first embodiment.

Therefore, in the third embodiment the bezel 21A can also be attached and detached to and from the case band 13 through the procedures as described in the first embodiment without requiring a tool, and thus the object of the present invention can be achieved.

In the above-mentioned respective embodiments, the bezel functions as a rotating bezel which can be rotated at will. However, the bezel may be a non-rotating type, or the rotation of the bezel may be limited to a fixed-angle rotation. Additionally, the present invention is applicable to a clock.

According to the present invention, an engagement ring fitted to one of an annular convex of a case band and a bezel is resiliently brought into tight contact with a stopper slope of an engagement convex formed on the other of the annular convex and the bezel to maintain the attachment of the bezel. Also, the relative engagement and disengagement between the engagement convex and the engagement ring is effected by moving the bezel through a releasable screw-engagement between a male screw of the annular convex and a female screw of the bezel. Thus, such a timepiece can be provided whose bezel can be easily attached and detached by a user without requiring a special-purpose tool.

What is claimed is:

1. A timepiece, comprising:

a cover glass;

a case band including an annular convex to which said cover glass is attached at the inner periphery of said annular convex, a male screw provided at the outer periphery of said annular convex, an annular groove provided at the outer periphery of said annular convex downwardly away from said male screw, and an annular clearance groove provided between said annular groove and said male screw;

a soft and resilient engagement ring fitted to said annular groove such that the engagement ring projects out from said annular groove; and a bezel having a female screw releasably engaging with said male screw and an annular engagement convex disposed below said female screw, said female screw passing through said male screw to be disposed within said clearance groove, said engagement convex having a stopper slope which tightly contacts with the outer periphery of said engagement ring.

2. A timepiece comprising:

a cover glass;

a case band including an annular convex to which said cover glass is attached at the inner periphery of said annular convex, a male screw provided at the outer periphery of said annular convex, an annular engagement convex provided at the outer periphery of said annular convex downwardly away from said male screw, and an annular clearance groove provided between said engagement convex and said male screw, said engagement convex having a stopper slope;

a bezel having a female screw releasably engaging with said male screw and annular groove formed below said female screw, said female screw passing through said male screw to be disposed within said clearance groove; and a soft and resilient engagement ring fitted to said annular groove such that the engagement ring projects out from said annular groove, the inner periphery of said engagement ring tightly contacting with said stopper slope.

3. A timepiece as set forth in claim 1, wherein said bezel is adjustably rotated in a circumferential direction thereof.

4. A timepiece as set forth in claim 2, wherein said bezel is adjustably rotated in a circumferential direction thereof.

* * * * *